United States Patent [19]

Kaiser

[11] 3,977,507

[45] Aug. 31, 1976

[54] COIN TESTING ARRANGEMENT FOR PARKING METERS

[75] Inventor: Bernhard Kaiser, Villingen-Schwenningen, Germany

[73] Assignee: Kienzle Apparate GmbH, Villingen, Germany

[22] Filed: Sept. 19, 1975

[21] Appl. No.: 614,785

[30] Foreign Application Priority Data

Sept. 21, 1974 Germany ..... 2445204

[52] U.S. Cl. ..... 194/99; 194/101

[51] Int. Cl.[2] ..... G07F 3/02

[58] Field of Search ..... 194/97 R, 97 B, 99, 194/100 R, 101; 73/163

[56] References Cited

UNITED STATES PATENTS

| | | | |
|---|---|---|---|
| 2,233,654 | 3/1941 | Tratsch et al. | 194/97 R X |
| 2,596,122 | 5/1952 | Broussard | 194/101 |
| 3,481,442 | 12/1969 | Van Horn et al. | 194/97 R |

FOREIGN PATENTS OR APPLICATIONS

| | | | |
|---|---|---|---|
| 1,924,474 | 11/1970 | Germany | 194/100 R |
| 634,879 | 8/1936 | Germany | 194/101 |

*Primary Examiner*—Stanley H. Tollberg
*Assistant Examiner*—Joseph J. Rolla
*Attorney, Agent, or Firm*—Michael J. Striker

[57] ABSTRACT

Coins inserted into a parking meter are tested as to diameter, the presence of one or more holes and the content of ferromagnetic material. In the latter test, the coins are transported through a coin transport channel extending intermediate a coin-insertion location and a coin receptacle. The channel has a breadth which exceeds the thickness of the coins to be processed by an amount permitting coins passing through the channel to shift in direction transverse to the direction of their travel. A magnet arrangement attracts magnetically attractable coins into contact with a wall of the channel as such coins pass through the channel. A sensing arrangement controls the setting of a parking time in dependence upon whether coins passing through the channel are attracted into contact with the wall. The sensing arrangement includes a sensing member which extends into the coin transport channel so positioned and mounted as to be displaced to a predetermined position by a coin which during its travel is being magnetically held against the wall. The setting of a parking time is prevented unless the sensing member is caused to assume the predetermined position.

4 Claims, 9 Drawing Figures

COIN TESTING ARRANGEMENT FOR PARKING METERS

BACKGROUND OF THE INVENTION

The invention relates to a coin testing arrangement for parking meters. When a coin is inserted into a parking meter of the type in question, a coin transporting mechanism is activated and diameter-testing and hole-testing operations are initiated and performed by means of sensing levers. These sensing levers, if the coin is sensed as having the correct diameter and as being free of holes, effect a time setting during the further course of the coin transport movement. After the sensing levers have completed the setting they transport the coins into a coin box.

Besides the generally conventional testing of the diameter of a coin to determine its genuineness, more and more use is being made of supplemental testing methods for preventing unlawful setting of the timing mechanism of automatic parking meters. To this end, there have come into use testing methods which test an inserted coin or coin-like object to determine whether it has a hole. These testing methods answer an urgent need, particularly because of the increasing use of metallic slugs deliberately employed to effect setting of the parking-time timing mechanism of the meter.

A further consideration which must be taken into account in designing a truly effective testing system is that unlawful so-called play money made of synthetic plastic has come into circulation, particularly in certain countries and localities, with such play coins having outer dimensions and surface stampings fashioned to exactly simulate those of genuine metal currency. In order to differentiate such plastic coins from similar genuine metallic coins, one possibility which has come to mind is the utilization of magnetic force fields for detecting the characteristics of iron-containing metal coins.

Known already is a considerable number of coin testing devices operative, on the basis of the action of a magnetic field in cooperation with the iron content of the coin material, for sorting coins to be tested, for routing coins into different transport channels, for rejecting unacceptable coins, etc. In most cases, these arrangements are very expensive, are composed of numerous component parts, require considerable space for installation, and accordingly are not well suited for use in parking meters.

Federal Republic of Germany Utility model DB-GM 1,745,460 discloses a simple magnetic coin testing arrangement having a magnet in the coin channel for deflecting a coin under magnetic force into a certain direction. Also, it is proposed to use a permanent magnet having the form of a circular disk so magnetized that the magnetic force lines outside extend about approximately each half of the disk. A magnetically attractable coin falls under its own weight through the field line zone of the magnetic disk and, due to the action of the attractive forces, rolls down with its rim surface upon the magnet disk. Then, a genuine coin is deflected into a coin channel after which, if the coin then passes a diameter test, activation of the parking meter is made to occur. A coin or coin-like object which is not magnetically attractable is not subjected to any deflection by the magnetic disk, but instead falls directly downwards into the coin box, without activating the parking meter.

The effectiveness of the magnetic force over the opposite circular-arc-shaped rim surfaces upon the coins is very meager, because the two surfaces in theory contact only a short line corresponding to the coin thickness. Any slug made of iron-containing metal and having coin-like dimensions passes through the arrangement without being sorted out as non-genuine. Also, it is necessary to provide two separate channels for coins, one for the genuine and the other for the not genuine coins.

Federal Republic of Germany published patent application DT-OS 2,243,221 discloses another magnetic coin testing technique. A rotatably mounted arresting lever in its rest position blocks with its one end a feeler pin for the proper-diameter determination, and with its other end, on which is carried a magnet, it extends into the coin travel path. The magnet testing lever cooperates via a pivot arm with a swingable diameter-testing device in such a manner that a diameter-sensing element (the feeler pin) is arrested in an inoperative position. The magnetic arm of the arresting lever projects, in preparation for the diameter testing, into the coin-insertion slot. Only if the inserted coin is ferromagnetic does the magnetic arresting arm, during transport of the coin and due to the attractive force between the coin and the magnetic arresting arm, become pulled along to release the feeler pin constituting the actual sensing element for the diameter-testing operation.

However, this pre-condition to the initiation of the diameter-testing operation, and thereby the setting of parking-time timing mechanism, is met by simple perforated disks so long as these have a sufficient iron content and have diameters corresponding to those of genuine coins. Additionally, the arresting lever is held in the arresting position only under the force of its own weight; as a result, slugs minted to have a special surface roughness characteristic or having surface projections can cause hooking-on, or other frictional engagement of the sides of the arresting lever, and thereby cause the arresting lever to undesirably effect the aforedescribed activation of the meter.

SUMMARY OF THE INVENTION

It is an object of the invention to provide automatically settable parking meters of the aforedescribed type with a supplemental and simple coin testing arrangement operative, on the basis of the magnetic conductivity of the coin material, for differentiating between magnetically attractable, genuine coins from similar non-magnetic, not genuine coins, with all types of inserted coins being accepted by the meter, but with magnetically non-attractable coins not effecting a setting of the parking-time timing mechanism. Also, the coin testing arrangement should prevent the setting of the timing mechanism from being triggered by counterfeit coins or perforated disks of the right material and diameter. In general, the arrangement for testing the coins for genuineness should be so designed that, with very simple means, it prevents the success of virtually any attempt to unlawfully activate the parking meter by means of coin-like objects.

To achieve these objects, and others, use is made of a coin transport channel having a breadth substantially greater than the thickness of the genuine coins to be processed, so that coins travelling through the coin transport channel can be shifted transverse to their transport direction. At the region of the coin transport channel where testing is to occur, the channel wall is provided with one or more magnets. A spring-loaded sensing lever normally projects into the coin channel through an opening in that wall of the channel which is provided with the magnet or magnets. Accordingly, if a magnetically attractable coin is moved through this portion of the channel by the coin transporting mechanism, the magnets will pull the coin sideways into sliding contact with the associated channel wall, as the coin continues to travel through the channel, thereby deflecting the sensing lever against the force of its biasing spring into a position in which it permits setting of a parking time to be effected.

According to a preferred concept of the invention, the breadth of the coin transport channel, which anyway must be at least somewhat greater than the thickness of the coins which the meter is to be capable of processing, is made still greater, in order to create for coins in the coin transport channel an additional degree of freedom of movement which brings about certain further advantages explained below.

A broadening can be effected by means of a shim or intermediate disk between the stationary mounting frame and the coin transporting mechanism. The shiftability transverse to the transport direction is utilized in order to establish a path of movement for activating a time-setting mechanism. After the performance of the diameter test, the coin, which is being pushed loosely through the coin channel, is fed independently, of the diameter test into a magnetic testing zone at which are provided one or more magnets mounted on any anyway present stationary wall of the coin channel.

To avoid the creation of an additional space requirement, the magnets can be mounted in the stationary side wall. To this end there is for example provided in the side wall a blind bore or other opening into which the magnet can be inserted. The magnet can then be secured in place using for example glue or cement. If a ferromagnetic coin pushed from behind by a coin transport segment arrives at the magnetic testing zone, it will be immediately attracted to the stationary side way of the coin channel by the force of magnetic attraction. At the location of the attracting magnets, there projects into the coin channel through an opening in the side wall of the channel a spring-biased sensing lever. This sensing lever effects operation of the time-setting means, if the sensing lever is not too much deflected by an object passing through the coin channel. The extent of the deflection of the sensing lever is determined by a perforation-free coin attracted into flat contact against the coin-channel side wall provided with the attracting magnets and acting against a sensing nose on the sensing lever; preferably, the setting of the sensing nose can be finely adjusted. Even a coin-like object, such as for example a ferromagnetic button, can be detected by the sensing lever as not being a genuine coin, if the sides of the coin-like object have surface concavities greater than those of a genuine coin.

Of course, magnetically attractable but perforated disks are also detected as not being genuine coins, and in response to such detection activation of the time setting means is prevented. Non-magnetic objects inserted through the coin-insertion slot are pushed sideways by the sensing nose of the sensing lever because they are not magnetically attracted; otherwise expressed, non-magnetic objects passing the sensing lever are forced sideways to a position preventing activation of the time-setting means.

All in all, if the parking meter construction is a given, the only additional expense required is that involved in the provision of one or more magnets whose disposition and magnetic action, in combination with that of the aforedescribed sensing lever, make possible the detection of a large number of slugs, phones and coin-like objects and the acceptance of the latter without any effect upon the time-setting means of the parking meter. All coin-like objects which can be inserted into the coin-insertion slot travel without hindrance, and without danger to the coin transport mechanism, through a coin transport channel widened in accordance with the concept of the present invention, and conveyed into the coin receptacle of the parking meter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
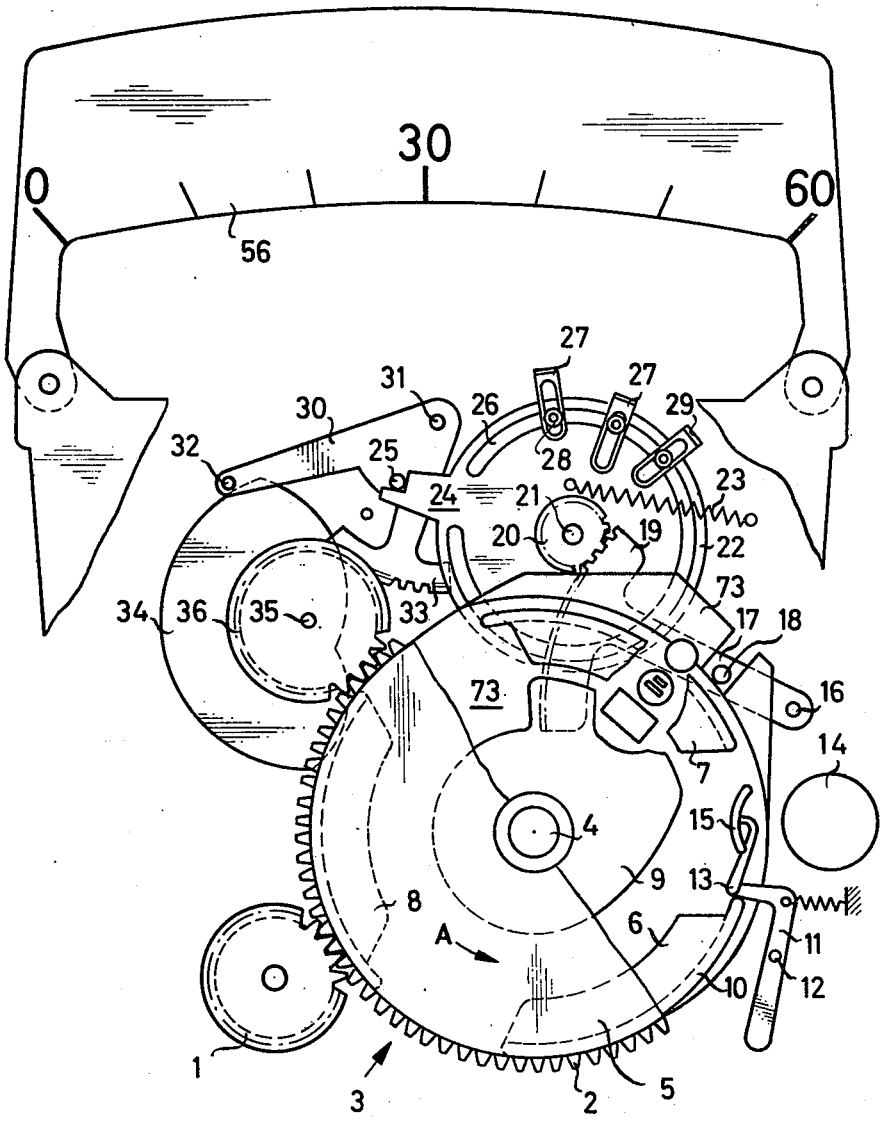
FIG. 1 depicts some of the components of a parking meter of the type to which the inventive concepts can be applied, including in particular the components of the coin transport mechanism of the meter.

Referring to FIGS. 1–4, there will first be described how the sensing of coins and the setting of the timing mechanism is performed with a parking meter of the type in which the invention is realized.

A gear 1 is driven by a drive spring or by another drive mechanism. The gear 1 drives a gear 2 forming part of the coin transport mechanism 3. The coin transport mechanism 3 is mounted on a shaft 4 and is comprised, on the one hand, of the gear 2 already mentioned and, on the other hand, of a disk 5 which is arranged coaxial with the gear 2 and fixedly connected to the gear 2. Likewise fixedly connected to the gear 2 and the disk 5 are coin transport segments 6, 7 and 8. The parts 2, 5, 6, 7, 8 are fixedly connected to each other to form a structural unit and are secured to the shaft 4, which is rotatably mounted.

Stationarily connected with a mounting frame 73 and arranged between the latter and the coin transport mechanism 3 is a guide segment 9. Each of the coin transporting segments 6, 7, 8 is provided with an arresting rim 10 by means of which the transport segment can cooperate with an arresting lever 11. The arresting lever 11 is mounted on a pin 12 and, in the FIG. 1 position thereof, hooks itself with the arresting rim 10 at an angled portion 13, so that the arresting lever 11 acts as a detent for the coin transport mechanism 3. However, as soon as a coin 14 is inserted, the coin acts upon a circular-arc-shaped part 15 on the arresting lever 11, so that the latter swings in counterclockwise direction about the pin 12. The angled portion 13 of the arresting lever 11 accordingly releases the coin transport mechanism 3, and the latter can now be driven by means of the drive mechanism, via the gears 1 and 2, in the direction of the arrow A in FIG. 1. However, as soon as a coin 14 is inserted, the coin acts upon a circular-arc-shaped part 15 on the arresting lever 11, so that the latter swings in counterclockwise direction about the pin 12. The angled portion 13 of the arresting lever 11 accordingly releases the coin transport mechanism 3, and the latter can now be driven by means of the drive mechanism, via the gears 1 and 2, in the direction of the arrow A in FIG. 1.

Mounted on a pin 16 is a sensing lever 17 provided with a feeler pin 18. The sensing lever 17 is provided at its left end with a gear segment 19 by means of which it meshes with a small gear 20 mounted on a shaft 21. The gear 21 is connected via the shaft 21 with a setting disk 22. A spring 23 pulls on the gear 20 and on the setting disk 22, continuously trying to turn these two components clockwise until the setting disk 22 with its stop nose 24. abuts against a pin 25. Mounted in a slit 26 of the setting disk 22 are setting members 27, of which there are as many provided as there are different kinds of coins which the parking meter must be capable of accepting and processing. The setting members 27 are adjustably arranged in the slit 26 by means of screws 28. They have angled tongues 29 serving as abutment parts for the pin 25, with their radial position relative to the disk centerpoint constituting a measure for the amount of time purchased for the associated kind of coin.

The pin 25 is arranged on a setting lever 30 mounted on a stationary pin 31 provided, not only with the pin 25, but furthermore with an additional pin 32 at its arm. Also, the setting lever 30 has a gear segment 33 serving to effect the time setting in a manner described below. The setting lever 30 with its pin 32 senses a cam disk 34 secured on a shaft 35. Also connected with the shaft 35 is a gear 36 which is driven by the gear 2, with a transmission ratio of 1:3, i.e., for each complete revolution performed by the gear 2, the gear 36 performs three revolutions. Accordingly, during each coin transport operation, the gear 2 moves through 120°, and in correspondence thereto the gear 36 and accordingly the cam disk 34 each perform one complete revolution.

The coin transport and time setting operation will be described now with respect to FIGS. 2 and 4. As soon as the coin 14 has been inserted into the insertion slot, the arresting lever 11 is pivoted and its angled portion 13 releases the arresting rim of the coin transport segment 6, so that the coin transport mechanism 3, driven by gear 1, can turn in counterclockwise direction. As a result, the coin, guided by the stationary coin-guiding segment 9, passes the sensing lever 17, and the coin cooperates with the feeler pin 18. As can be seen from FIG. 2, the coin 14 during its transport projects beyond the periphery of the coin transport mechanism 3, so that the coin via the feeler pin 18 pivots the sensing lever 17. The sensing lever 17, via the gear 20, sets the setting disk 22 into a circumferential position corresponding to the diameter of the coin 14. In this position, under the control of a cam disk 40 mounted on the shaft 35, a further sensing lever 41 mounted on a pin 42 is rendered operative. The sensing lever 41, with its two angled off tongues provided on its two arms 43, 44, senses the cam disk 40. On its uper arm 45 the sensing lever 41 has an arresting nose 46 by means of which it cooperates with pins 47 on the setting members 27.

Figure 2:
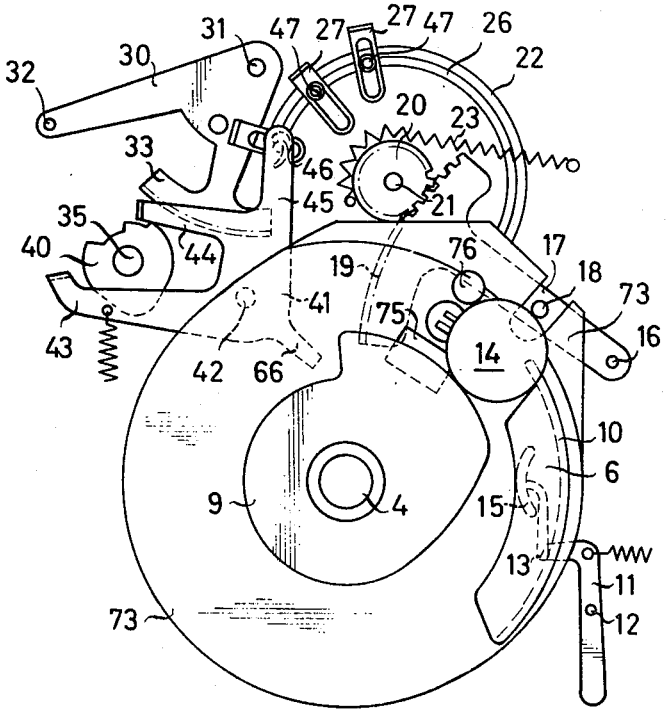
FIG. 2 depicts further details of the coin transport mechanism, in another position.

As soon as the coin by means of its peripheral portion pivots the sensing lever 17 and according has turned the setting disk 22 into a certain angular position, the sensing lever 41, controlled by the cam disk 40, becomes operative, i.e., its arm 44 is released so that now the sensing lever 41 with its arresting nose 46 can swing around counterclockwise and arrest the setting disk 22 at the pin 47, as shown in FIG. 2. The angular position of a setting member 27 is a measure for the correct diameter of the inserted coin 14. Because of the considerable transmission ratio between the gear segment 19 and the setting disk 22, even small differences in the diameter of the coin 14 manifest themselves in very much greater differences in the setting path of each of the adjusting members 27. Thus, if a coin of improper diameter is inserted, than at the moment in which the sensing lever 41 is rendered operative by the cam disk 40 none of the pins 47 of the setting members 27 will be in the rest position relative to sensing lever 41, so that the setting disk 22 will not, as shown in FIG. 2, be arrested in position, but instead will be pulled back by the spring 23 into the FIG. 1 position.

Figure 3:
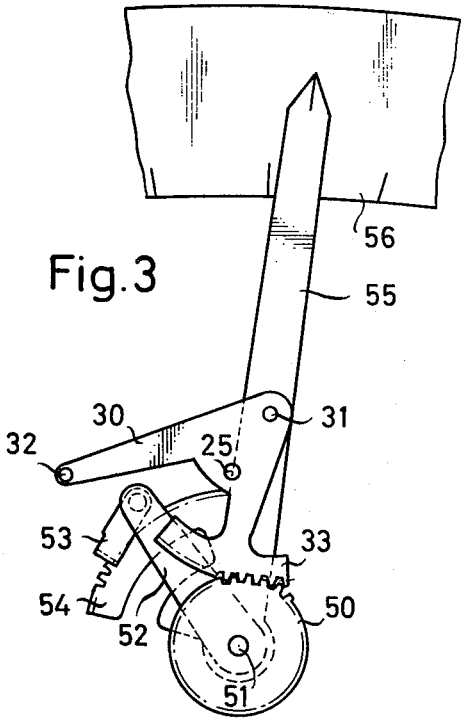
FIG. 3 and 4 depict the arrangement for setting the parking time.
Figure 4:
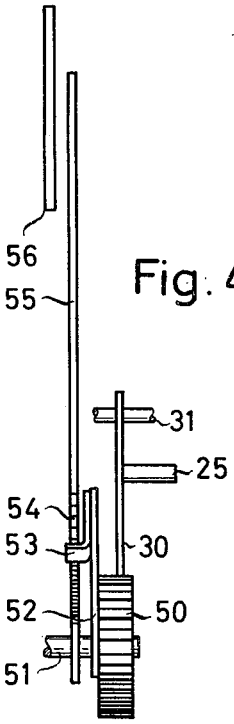

Subsequent to the setting of the sensing lever 41 to the arresting position shown in FIG. 2, in the cases when the inserted coin has been detected as having the correct diameter, the time setting is performed by means of the setting lever 30 and the parts shown in FIGS. 3 and 4. As soon as the sensing lever 41 has been arrested, the setting lever 30 and accordingly the pin 25 also are swung by the cam disk 34 counterclockwise until the pin 25 abuts against one of the setting members 27 or the angled tongues 29 thereof. With this the time setting is performed via the gear segment 33. The gear segment 33 meshes (FIG. 3) with a gear 50 mounted on an indicator shaft 51. Connected with the gear 50 is a lever 52 which carries a setting dog 53. Via the setting dog 53 the lever 52 acts upon a segment 54 on which is secured the time indicator 55. When the setting lever 30 performs its sensing movement, the indicator 55, via the gear segment 33, the gear 50, the lever 52, the setting dog 53 and the segment 54, is set in front of the indicator scale 56. The distance through which the setting lever 30 moves before its pin 25 abuts against the angled tongue 29 of a setting member 27, the latter occupying its setting position, is accordingly a measure of the distance through which the indicator moves from its zero position to its set position.

In the foregoing, the time setting was described as being dependent upon the testing of the diameter of the coin, with the diameter test involving two sensing levers, firstly the sensing lever 17 which effects the setting of the setting disk 22, and secondly the sensing lever 41 which determines whether the diameter sensed by the sensing lever 17 corresponds to the diameter of a proper coin.

If the coins or coin-like objects which are inserted have diameters not corresponding to those of proper coins, then the sensing lever 41 is not even rendered operative, i.e., the setting disk 22 is not arrested and the setting lever 30 accordingly cannot effect the setting of a parking time, because when the sensing lever 41 is not arrested the spring 23 immediately pulls the setting disk 22 into the starting position thereof shown in FIG. 1, and finally the pin 25 abuts on the setting lever 30 at the abutment nose 24 and accordingly prevents a setting of parking time.

With particular respect now to FIGS. 5–9 there will be described the inventive arrangement. The inventive arrangement, besides testing the diameters of the coins and detecting perforations, is intended to distinguish between magnetically attractable genuine coins and magnetically non-attractable not genuine coins.

There are provided on the stationary coin channel wall 74, which forms part of the mounting frame 73, in the same plane as the inner wall 74, one or two permanent magnets 75, 76. The securing of the magnets 75, 76 can be performed most simply using glue. The magnets are arranged downstream of the diameter testing zone, as considered in the direction of the transport movement of an inserted coin 14; i.e., after a diameter test has been completed, the coin 14 arrives at the region at which the magnets 75, 76 are arranged.

Arranging the magnetic testing zone offset in the transport direction has, on the one hand, the purpose of making the testing methods completely independent of each other and, on the other hand, the coin 14 should be able to move completely freely into the effective region of the magnetic force field. If the arrangement involves only one magnet 75, then such magnet is preferably located at the height of the support for the coin 14 on the circular-arc-shaped guide segment 9 and simultaneously on the radial connecting line between, on the one hand, a nose 64 of a spring-loaded sensing lever 60, the nose 64 extending into the coin transport channel 77, and, on the other hand, the central shaft 4.

If two magnets 75 and 76 are provided, then these are arranged on a diametral line through the shaft 4 in the stationary coin channel wall 74 with spacing from each other and at diametrally opposite sides of the sensing nose 64. The radial distance is so selected that coins of all expected sizes, supported on the guide segment 9, are guided through the magnetic force-line field of the two magnets 75, 76, and accordingly the magnetic forces cause a ferromagnetic coin 14/1 to be supported plane-parallel against the coin channel wall 74 as it is guided through the magmetic testing zone.

If two magnets 75, 76 are used, these are arranged to the side of a coin to be tested and with opposite polarities, so that a magnetically conductive coin 14/1 guided by the transport mechanism 3 acts like an armature closing off a path for the force-line flux. The movement of the magnetically conductive coin 14/1 alongside the magnets 75, 76 (see FIG. 9) causes the sensing lever 60 to assume a deflected position in which it permits setting of the timing mechanism.

In order to assure that magnetic objects are dependably distinguished from non-magnetic objects, the coin transport channel 77 has a cross-sectional breadth (FIG. 9) which in the region of the magnetic testing zone is widened out to about twice the thickness of proper coins, in the illustrated embodiment. In this way, a non-magnetic disk, for example a plastic play coin, in passing by the nose 64 of the spring-biased sensing lever 60, is deflected by the latter leftwards (as viewed in FIG. 9), and accordingly the sensing lever 60 does not assume that deflected position thereof in which the timesetting mechanism is released; this action is explained in somewhat greater detail below.

Figure 7:
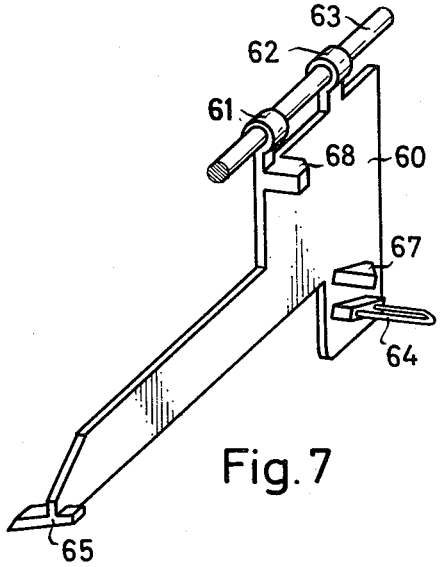

The sensing lever 60, which assumes an angular position dependent upon the passage of a coin through the magnetic testing zone, is depicted in FIG. 7. The sensing lever 60 is rotatably mounted on a shaft 63 by means of two fastenings 61 and 62. A spring 79 (shown in FIG. 9 but not shown in FIG. 7) exerts a biasing force upon the sensing lever 60 such as to cause it to pivot forwards out of the picture plane of FIG. 7, as soon as the lever 60 is released. The sensing lever 60 has a nose 64 for the sensing of the side of a coin 14, a control nose 65 by means of which lever 60 cooperates with a nose 66 on the sensing lever 41, and two further noses 67 and 68 operative for bringing the sensing lever into and out of its operative position at the proper times.

Figure 5:
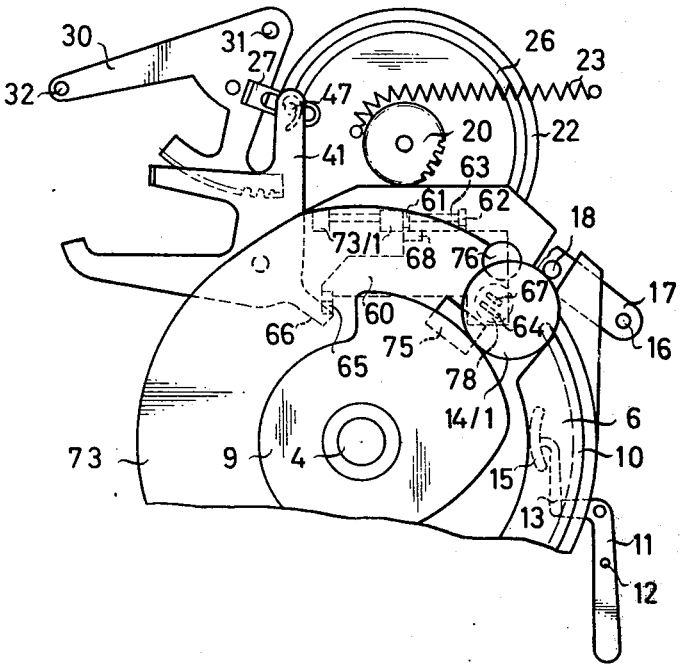
FIG. 5 depicts the arrangement after the completion of the diameter test of a genuine coin upon entry of the latter into the magnetic testing zone.
Figure 6:
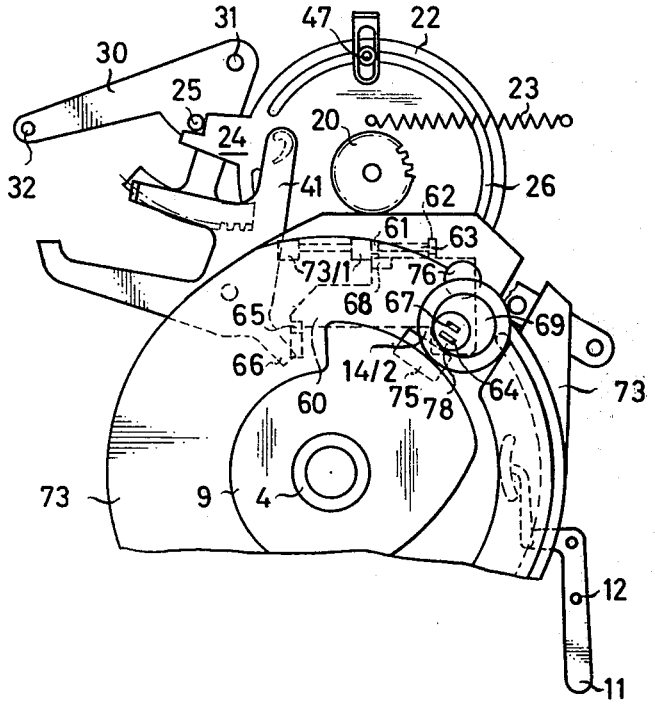
FIG. 6 depicts the arrangement of FIG. 5, but with a coin-like object (perforated disk) in the magnetic testing zone.
Figure 9:
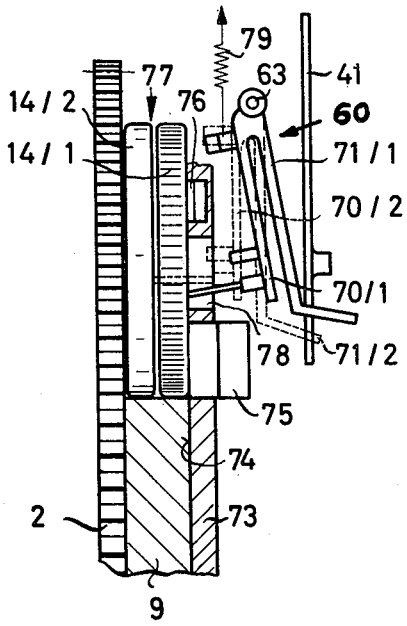
FIG. 9 is a section taken through the magnetic testing zone, showing the positions of the sensing lever when magnetically attractable genuine coins and non-magnetic coins or coin-like objects pass through the magnetic testing zone.

As can be seen in FIGS. 5, 6 and 9, the sensing lever 60 is arranged behind the mounting frame 73 and in front of the setting disk 22, and in such a manner that when a coin passes by the sensing lever 60 it can sense its lateral position within and relative to the walls of the coin transport channel 77. To permit lateral movement of the sensing nose 64 into the coin transport channel 77, there is provided in the stationary coin channel wall 74 an opening 78 whose provision furthermore makes it possible for the nose 67 to cooperate with the coin transport mechanism 3 and during a certain phase of operation hold the sensing lever 60 in its starting position.

The shaft 63 is rotatably mounted on two sockets 73/1 of the mounting frame 73. The nose 68 of the sensing lever 60, when the coin transport mechanism 3 is in its inoperative position, serves to hold the sensing lever 60 out of its operative position in cooperation with the blocking rim 10 of the coin transport segment 6, 7 or 8. Only when a coin transport operation is initiated by the insertion of a coin does the nose 68 move away from the blocking rim 10 thereby permitting the sensing lever 60 to be brought into operative position.

FIG. 5 depicts the entire coin testing system in a phase of operation in which by means of the sensing lever 41 a coin 14/1 has been recognized as having the correct diameter. Accordingly, the setting disk 22 is arrested at the pin 47 of the setting member 27. A setting of the timing mechanism has not yet occurred, because the setting lever 30 does not begin its sensing movement, controlled by the cam 34, until a later time. Meanwhile, the coin 14/1, determined to be of the proper diameter, leaves the diameter-testing zone and thereafter, relieved of the sensing pressure of the feeler pin 18, and freely movably by the transport segment 6, is pushed forwards into the region of the attractive force of the magnets 75 and 76.

A magnetically attractable, genuine coin 14/1 (FIG. 9) is immediately attracted by the force field and lies against the inner side of the coin channel wall 74. Meanwhile, however, the sensing lever 60 has been released, so that lever 60, under the biasing force of spring 79, is biased in clockwise direction. However, the lever 60 cannot swing clockwise (as viewed in FIG. 9) because the considerably stronger attractive force of the magnets 75, 76 attract the ferromagnetic coin 14/1 like an armature. Accordingly, the nose 64 of the sensing lever 60 is constrained to rest against the side surface of the coin, so that the sensing lever 60 is held, against the biasing force of spring 79, in its counterclockwise-pivoted end position. In this end position, the sensing lever 60 allows the time-setting means 41, 30 to properly set the appropriate parking time. As the coin 14/1 continues to be transported, it finally leaves the magnetic testing zone and immediately thereafter the blocking rim 10 of the transport segment 6 holds the sensing lever 60 out of its operative position, by acting on the nose 67 of the sensing lever.

In FIG. 6, a perforated disk 14/2 of ferromagnetic material and having the diameter of a proper coin has been inserted into the arrangement and is located in the magnetic testing zone. The previously performed diameter test, due to the correspondence of the diameter of perforated disk 14/2 to that of a proper coin, has set the time-setting means, in particular the parts 17, 22, 27, 41, to the positions thereof shown in FIG. 5. Also, the magnetically attractable perforated disk 14/2, in passing by the magnets 75, 76, is attracted to them in the same way as a genuine coin. However, because of the hole 69 in the disk 14/2, the sensing nose 64 of the sensing lever 60, under the biasing force of spring 79, encounters no resistance and passes through the hole 69. As a result of this swinging movement of the sensing lever 60, the control nose 65 of the sensing lever 60 acts upon the nose 66 of the sensing lever 41 and causes the latter to swing clockwise. As a result, the arresting of the disk 22 at the pin 44 by means of the lever 41 is terminated, and the disk 22 turns back, under the action of biasing spring 23, to the starting position shown in FIG. 1, and before the setting lever 30 was able to perform its sensing operation and thereby effect the setting of the parking time. Thereafter, the perforated disk 14/2 is transported unhindered into the coin box; this is because the sensing lever 60, by virtue of the contact of its nose 67, 68 (each of which has an inclined leading surface, as shown in FIG. 7) with the transport segments 6, 7, 8 as the latter pass by, is brought out of the operating region at the proper times.

Figure 8:
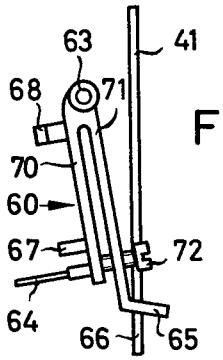
FIGS. 7 and 8 depict designs for the sensing lever.

The nose 64, too, is provided with an inclined leading face, in order to prevent hooking into an object to be tested, and also in order to be able to detect coin-like objects having at their sides surface concavities deviating from those of proper coins, which might be the case for example with a ferromagnetic button. In the latter instance, where the outer dimensions and the metallic characteristic of the object come very close to those of a genuine coin 14/1, it may be advantageous if the sensing arrangement is provided with a fine-adjustment possibility which is afforded if the relationship of the position of the nose 64 relative to the control nose 65 can be adjusted extremely precisely using a fine-adjustment screw 72 (FIG. 8).

To this end, the sensing lever 60 (FIG. 8) is fork-shaped and its one arm 70 carries the noses 64, 67 and 68 whereas its other arm 71 carries the control nose 65. The two arms 70, 71 are made of resilient or elastic material, and their spacing from each other can be set very precisely by means of the fine-adjustment screw 72. In this way, it is possible to very exactly set the critical penetration depth of the nose 64, beyond which the object being tested whether magnetic or non-magnetic will be rejected and not cause a parking time to be set.

FIG. 9 indicates that a coin 14/1 will cause a parking time to be set only if the criteria of diameter, ferromagnetic material content and sensed surface characteristics all correspond to those of a proper coin. If there is such correspondence, then the sensing lever 60 assumes the single position in which setting of a parking time is effected, as indicated in FIG. 9 by the arm 70/1 or 71/1. If the sensing lever 60 is caused by the inserted object to assume any other position (see for example position 70/2 or 71/2), the testing arrangement will reject the object as being a slug or phony 14/2, and the person attempting to utilize such slug will not achieve the result he desires.

By way of further explanation, it should be noted that a plastic coin 14/2 corresponding in every dimensional respect to a genuine coin will be recognized as a phony in the magnetic testing zone, because the magnetic field of the permanent magnets at such zone will have no effect upon the non-ferromagnetic material of the phony. Accordingly, the plastic coin 14/2 will travel loosely through the magnetic testing zone, and the inclined nose 64, urged by the spring 79, will move into the coin channel 77 and press the plastic coin 14/2 to the opposite side of the widened coin channel 77, so that the plastic coin will move through the magnetic testing zone without constraining the sensing lever 60 to assume the position thereof which effects setting of a parking time.

It will be understood that each of the elements described above, or two or more together, may also find a useful application in other types of constructions differing from the types described above.

While the invention has been illustrated and described as embodied in a testing mechanism in a parking meter of a particular design, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a parking meter, a coin testing arrangement, comprising, in combination, means defining a coin transport channel extending intermediate a coin-insertion location and a coin receptacle; coin transporting means operative for guiding an inserted coin through said coin transport channel, said coin transport channel being widened at a portion thereof to have a breadth which exceeds the thickness of the coins to be processed by the parking meter by an amount permitting coins passing through said portion to shift in direction transverse to the direction of travel of the coins; magnet means operative for attracting into contact with a wall of said coin transport channel coins which are magnetically attractable as such coins pass through said portion; and sensing means operative for controlling the setting of a parking time in dependence upon whether coins passing through said portion are attracted into contact with said wall, including a sensing member extending into said coin transport channel and so positioned and mounted as to be displaced to a predetermined position by a coin which during travel through said portion is being magnetically held against said wall and means for preventing setting of a parking time unless said sensing member is caused to assume said predetermined position.

2. In a parking meter as defined in claim 1, wherein said coin testing arrangements further includes means for determining whether a coin inserted into the parking meter is of a predetermined diameter and means for determining whether a coin inserted into the parking meter has a hole.

3. In a parking meter as defined in claim 1, wherein said magnet means includes two permanent magnets each flush with said wall, wherein said sensing lever has a sensing nose which is engaged by coins magnetically attracted into contact with said wall, wherein said magnets are located on diametrally opposite sides of said sensing nose and so oriented that coins magnetically attracted into contact with said wall travel past the region of said sensing lever in a plane of motion coincident with the plane of the coins.

4. In a parking meter as defined in claim 3, wherein the polarities of the ends of said permanent magnets which face coins passing through said portion are opposite so that magnetically conductive coins during their travel past said sensing lever form with said magnets an armature providing a path for magnetic flux extending between said magnets.

* * * * *